US006155231A

United States Patent [19]

Adachi et al.

[11] Patent Number: 6,155,231

[45] Date of Patent: Dec. 5, 2000

[54] THROTTLE VALVE CONTROLLER

[75] Inventors: Kazumasa Adachi; Yoshinori Taguchi, both of Aichi-ken, Japan

[73] Assignee: Aisin Seiki Kabushiki Kaisha, Kariya, Japan

[21] Appl. No.: 09/106,072

[22] Filed: Jun. 29, 1998

[30] Foreign Application Priority Data

Jun. 27, 1997 [JP] Japan ..... 9-172491

[51] Int. Cl.[7] ..... F02D 7/00; F02D 41/00

[52] U.S. Cl. ..... 123/399; 123/361

[58] Field of Search ..... 123/399, 361

[56] References Cited

U.S. PATENT DOCUMENTS

| | | | |
|---|---|---|---|
| 4,911,125 | 3/1990 | Sugawara et al. | 123/399 |
| 4,982,710 | 1/1991 | Ohta et al. | 123/399 |
| 5,062,404 | 11/1991 | Scotson et al. | 123/399 |
| 5,964,202 | 10/1999 | Takagi et al. | 123/361 |
| 5,992,384 | 11/1999 | Bauer et al. | 123/361 |
| 6,006,725 | 12/1999 | Stefanopoulou et al. | 123/399 |

FOREIGN PATENT DOCUMENTS

| | | |
|---|---|---|
| 2-125937 | 5/1990 | Japan . |
| 7-259618 | 10/1995 | Japan . |
| 7-332136 | 12/1995 | Japan . |

*Primary Examiner*—Kevin Shaver
*Assistant Examiner*—D A Bonderer
*Attorney, Agent, or Firm*—Sughrue, Mion, Zinn, Macpeak & Seas, P.C.

[57] ABSTRACT

A throttle valve controller includes a motor, a throttle valve driven by the motor, an accelerator sensor for setting a target position of the throttle valve, a throttle sensor for detecting the actual position of the throttle valve, a position control circuit for controlling the motor in accordance with a difference between the target position and the actual position of the throttle valve, a friction compensating circuit for compensating a positional error due to friction force affecting the throttle valve, and a driver for driving the motor with repetition of a control period in accordance with the position control circuit and the friction compensating circuit. The friction compensating circuit may compensate the positional error due to friction force during a control period together with the position control circuit. The motor may generate compensated torque in accordance with the friction force that affects the throttle valve. By doing this, the throttle valve may be controlled more accurately as if the resolution of the controller was increased.

7 Claims, 8 Drawing Sheets

THROTTLE VALVE CONTROLLER

BACKGROUND OF THE INVENTION

This application claims priority under 35 U.S.C. §119 [and/or §365] to "The Throttle Valve Controller", Application No. H09-172491 filed in JAPAN on Jun. 27, 1997, the entire content of which is herein incorporated by reference.

This invention relates to a throttle valve controller for electronically controlling the opening of the throttle valve. More particularly, this invention relates to a throttle valve controller using a D.C. motor to drive the throttle valve.

A conventional throttle valve controller uses a D.C. motor to drive the throttle valve. Such a D.C. motor is driven by a feed back controller employing a PID control (e.g., proportional integral and derivative control) based on a difference between a target position and an actual position. However, such a PID control may become rough in the long term due to varied friction forces affecting the slipping mechanism such as a reduction mechanism. In other words, response of the throttle valve may be deteriorated due to the variable friction forces of the slipping mechanism.

To solve such problems, various solutions have been proposed. For example, Japanese Laid-Open Patent No. H02-125937 discloses a scheme to add a friction compensator to the PID control. This conventional scheme will control the throttle valve more accurately due to compensated motor torque.

Japanese Laid-Open Patent No. H07-259618 discloses a pulsed current supplied to the motor. The pulsed current will act for the throttle valve to draw a small hysteresis loop till the throttle valve reaches the target position. The pulsed current will compensate the hysteresis torque of the mechanism that corresponds to the friction force of the mechanism.

Japanese Laid-Open Patent No. H07-332136 discloses an increased gain for the proportional control which is a part of the PID control in order to increase torque of the electric motor while the actual position of the throttle valve is close to the target position. The throttle valve is moved to the target position accurately due to increased torque of the electric motor.

Although various conventional schemes are proposed to compensate the friction force of the throttle valve control system, these conventional schemes may not properly control the throttle valve at certain areas such as near the fully closed position.

Japanese Laid-Open Patent Publication No. H07-332136 increases the gain for the proportional control with respect to a minor displacement of the throttle valve. However, the throttle valve may not be moved effectively when the increased gain is not high enough. Further, the throttle valve may be vibrated by hunting in case the increased gain is too high since this scheme does not consider any difference between dynamic and static friction forces.

Japanese Laid-Open Patent Publication No. H07-259618 always vibrates the throttle valve. Therefore, the throttle valve may not be moved effectively or may be vibrated by hunting due to the same reason as Japanese Laid-Open Patent Publication No. H07-332136.

Japanese Laid-Open Patent Publication No. H02-125937 distinguishes static friction force from dynamic friction force. However, the throttle valve may be overshot significantly upon switching from static friction control to dynamic friction control.

In the above conventional schemes, the PID controller continuously supplies electric power to the motor to follow the target position of the throttle valve within a set control period. Therefore, the throttle valve is kept moving due to a fixed amount of the electric power supplied to the motor within the set control period. Accordingly, the throttle valve may be opened excessively when the throttle valve passes over the target position. At the subsequent control period, the throttle valve will be closed by the reversed power supplied to the motor to get the target position. However, if this is the case, the throttle valve may be closed excessively in case the throttle valve again passes over the target position in the subsequent control period. The longer the control period, a more significant problem will occur so that the throttle valve is kept vibrating due to hunting or the throttle valve may be opened extremely so wide due to the overshoot.

To solve the above conventional problems, the control period may be shortened to increase resolution of the controller. However, a more precise controller is required to increase the resolution. As a result, the controller may be too expensive to be employed for typical applications.

Accordingly, a feature of the present invention is to solve the above conventional problems.

SUMMARY OF THE INVENTION

A feature of the present invention is to control the throttle valve accurately in an inexpensive manner.

To achieve the above features, the present invention comprises:

- a motor;
- a throttle valve driven by the motor;
- target setting means for setting a target position for the throttle valve;
- detecting means for detecting the actual position of the throttle valve;
- position control means for controlling the motor in accordance with a difference between the target position and the actual position of the throttle valve;
- friction compensating means for compensating a positional error due to friction force affecting the throttle valve; and
- driving means for driving the motor with repetition of a control period in accordance with the position control means and the friction compensating means.

In the present invention, friction compensating means may compensate the positional error generated by the friction force within the same time period as the position control means. The motor may generate compensated torque in accordance with the friction force affecting the throttle valve. By doing this, the throttle valve may be controlled accurately as if the resolution of the controller was increased. In other words, a control duration is shortened for the position control means in exchange for the extension of a control duration for the friction compensating means. Accordingly, the same hardware may be employed for more precise motor drive. Further, more accurate control will be achieved near the fully closed position of the throttle valve.

PREFERRED EMBODIMENT

Figure 1:
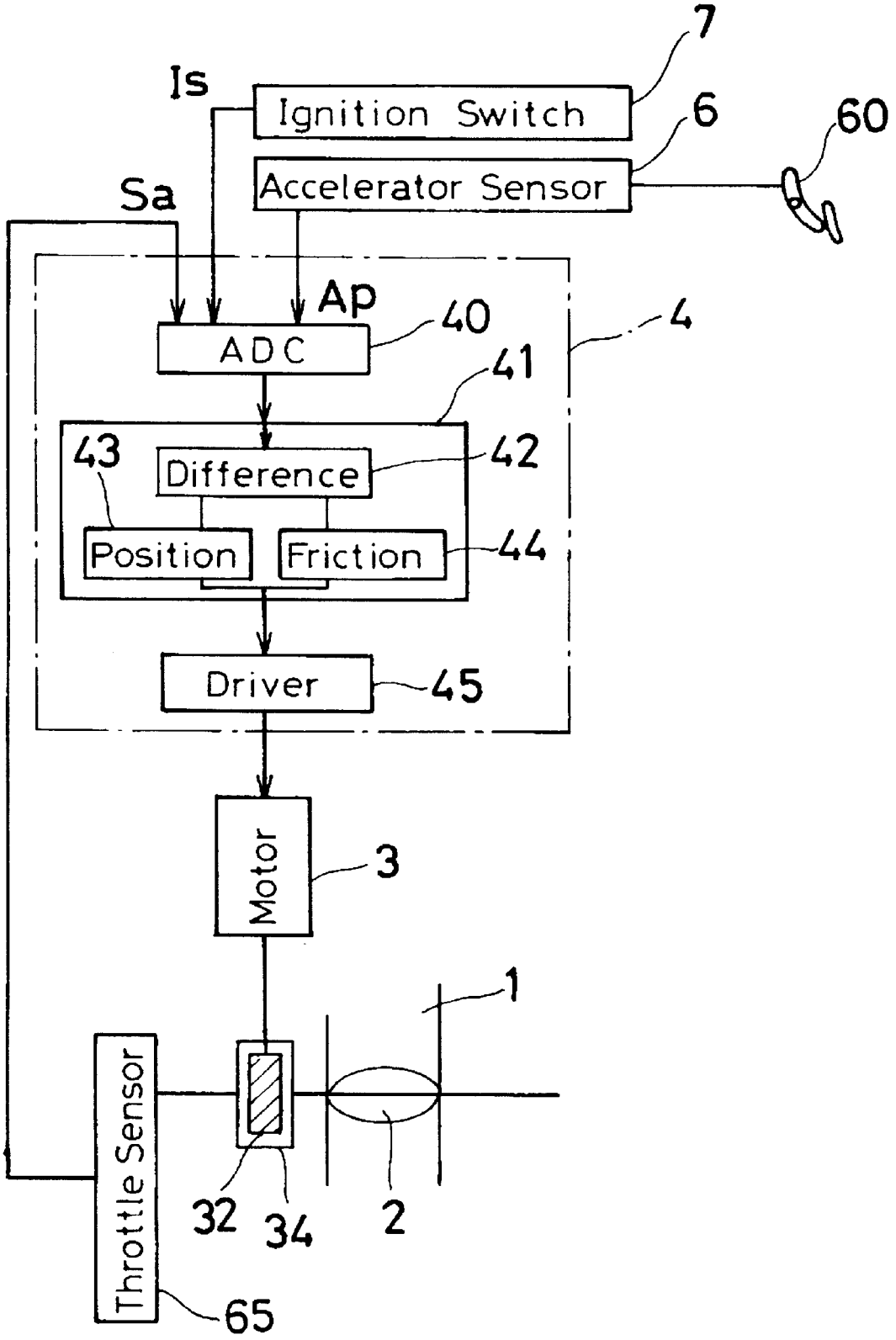
FIG. 1 is a block diagram showing a throttle valve controller and its peripheral devices.

Referring now to FIG. 1, a preferred embodiment of the invention is explained. FIG. 1 is a block diagram showing a throttle valve controller and its peripheral devices.

As shown in FIG. 1, a throttle valve 2 is pivotally supported in the intake passage 1 of the internal combustion engine (not shown). The throttle valve 2 is rotated in the passage 1 when a D.C. motor 3 drives a worm gear 32 and a worm wheel 34. The amount of mixture is regulated depending on the position of the throttle valve 2. The mixture is supplied to the internal combustion engine.

The D.C. motor 3 drives the throttle valve 2. Electric power is controlled by a duty control and is supplied from a controller 4 to the D.C. motor 3. An accelerator sensor 6 is connected to the controller 4 to detect the amount of depression of an accelerator pedal 60. A throttle sensor 65 is connected to the controller 4 to detect the present position of the throttle valve 2. An ignition switch 7 is connected to the controller 4 to detect the state of the ignition switch for example, for voltage compensation.

The accelerator sensor 6 generates a signal Ap. 5 The ignition switch generates a signal Is. The throttle sensor 65 generates a signal Sa. These three signals are fed to the Analog/Digital converter 40. The converted signals are fed to a processing unit 41. The processing unit 41 generates a duty ratio to control driving torque of the D.C. motor 3. A driver 45 supplies electric power to the D.C. motor 3 in accordance with the duty ratio set by the processing unit 41.

The processing unit 41 calculates a target position of the throttle valve 2 based on the signal Ap fed by the accelerator sensor 6. The processing unit 41 also calculates an actual position of the throttle valve 2 based on the signal Sa fed by the throttle sensor 65. The processing unit 41 further calculates the duty ratio so that the D.C. motor 3 drives the throttle valve 2 to reach the target position.

The processing unit 41 includes a difference calculating circuit 42, a position control circuit 43 and a friction compensating circuit 44. The difference calculating circuit 42 calculates a difference between the target and present positions of the throttle valve 2 when the signals Ap and Sa are supplied to the processing unit 41 from the accelerator sensor 6 and the throttle sensor 65. The position control circuit 43 calculates a proper duty ratio for the throttle valve 2 to reach the target position. Further, the friction compensating circuit 44 calculates the other duty ratio to compensate any positional error of the throttle valve 2 due to friction force affecting to the throttle valve 2. Both the position control circuit 43 and the friction compensating circuit 44 calculate the duty ratios in a set control period of time. The driver 45 supplies electric power in accordance with the two duty ratios supplied from the position control circuit 43 and the friction compensating circuit 44.

The position control circuit 43 sets the duty ratio to move the throttle valve 2 toward the target position. The friction compensating circuit 44 sets the other duty ratio to eliminate any hysteresis generated by static or dynamic friction forces affecting the throttle valve 2. The driver 45 combines both of the duty ratios to supply proper electric power to the D.C. motor 3.

Figure 2:
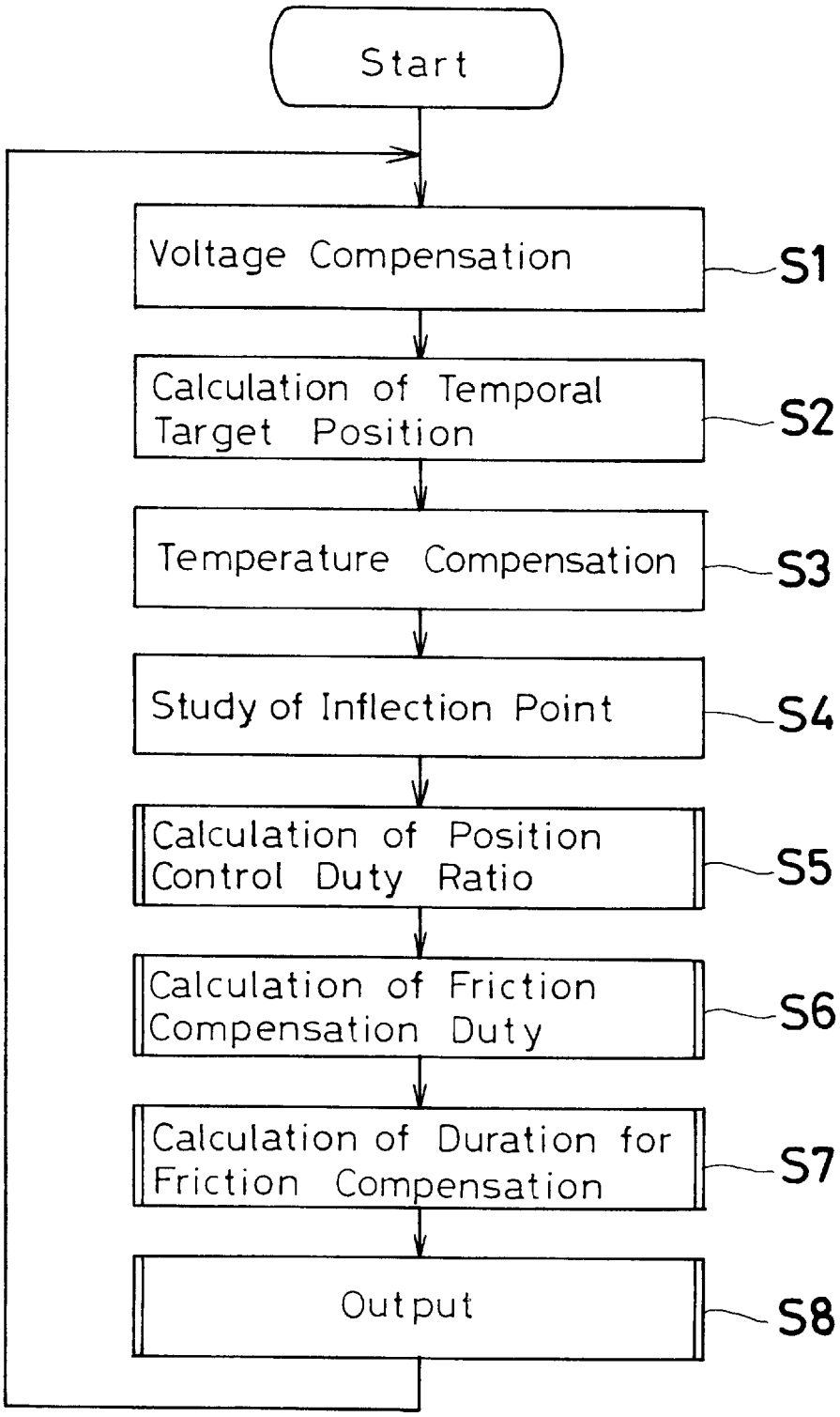
FIG. 2 is a flow chart showing a program executed by the motor driving unit.

FIG. 2 shows a flow chart executed by the processing unit 41. At step S1, voltage compensation is performed. The processing unit 41 selects a proper gain from stored data in a semiconductor memory (not shown) corresponding to the voltage supplied to the D.C. motor 3. Both of the duty ratios for the position control and the friction compensation will be compensated by the selected gain. At step S2, temporal target position is calculated. At step S3, temperature compensation is performed. At step S4, an inflection point of the throttle valve 2 is studied. At step S5, the duty ratio for the position control is calculated according to a formula explained later. Then, at step S6, the friction compensation duty is calculated. At step S7, the duration for the friction compensation is calculated. At step S8, the position control duty and the friction compensation duty are output to the driver 45 and then return to step S1. In this embodiment, the control period of the processing unit 41 is approximately 5 millisecond.

The position control duty is calculated by the following formula stored in the memory:

Position control duty=Proportional Member+Deviation Member+Integral Member+Throttle Position Maintaining Member wherein:

Proportional Member=Proportional Gain×Positional Difference

Deviation Member=Deviation Gain

Figure 3:
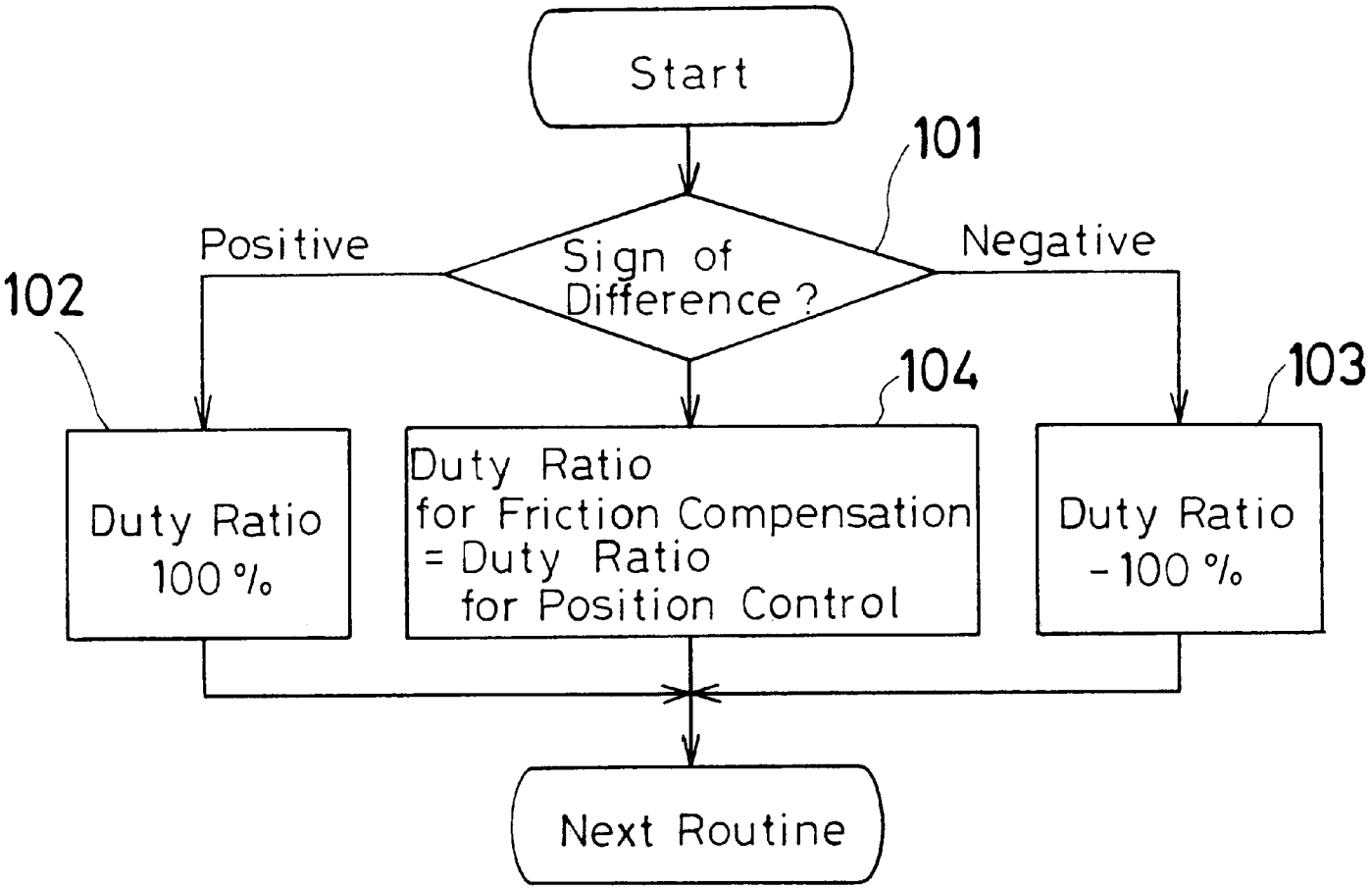
FIG. 3 is a flowchart showing a program for friction compensation.

×(Present Difference−Last Difference) Integral Member=S (Integral Gain×Position Difference) Throttle Position Maintaining Member =Gain×Present Position×Offset Value FIG. 3 shows a subroutine for the friction compensation. At step 101, the processing unit 41 judges the sign of the difference between the target position and the present position of the throttle valve 2. If the sign of the difference is positive, the duty ratio for the friction compensation is set to be 100% at step 102. If the sign of the difference is negative, the duty ratio for the friction compensation is set to be 100% at step 103. If the difference is zero, the duty ratio for the friction compensation is set to be the same value as the duty ratio for the position control.

Figure 4:
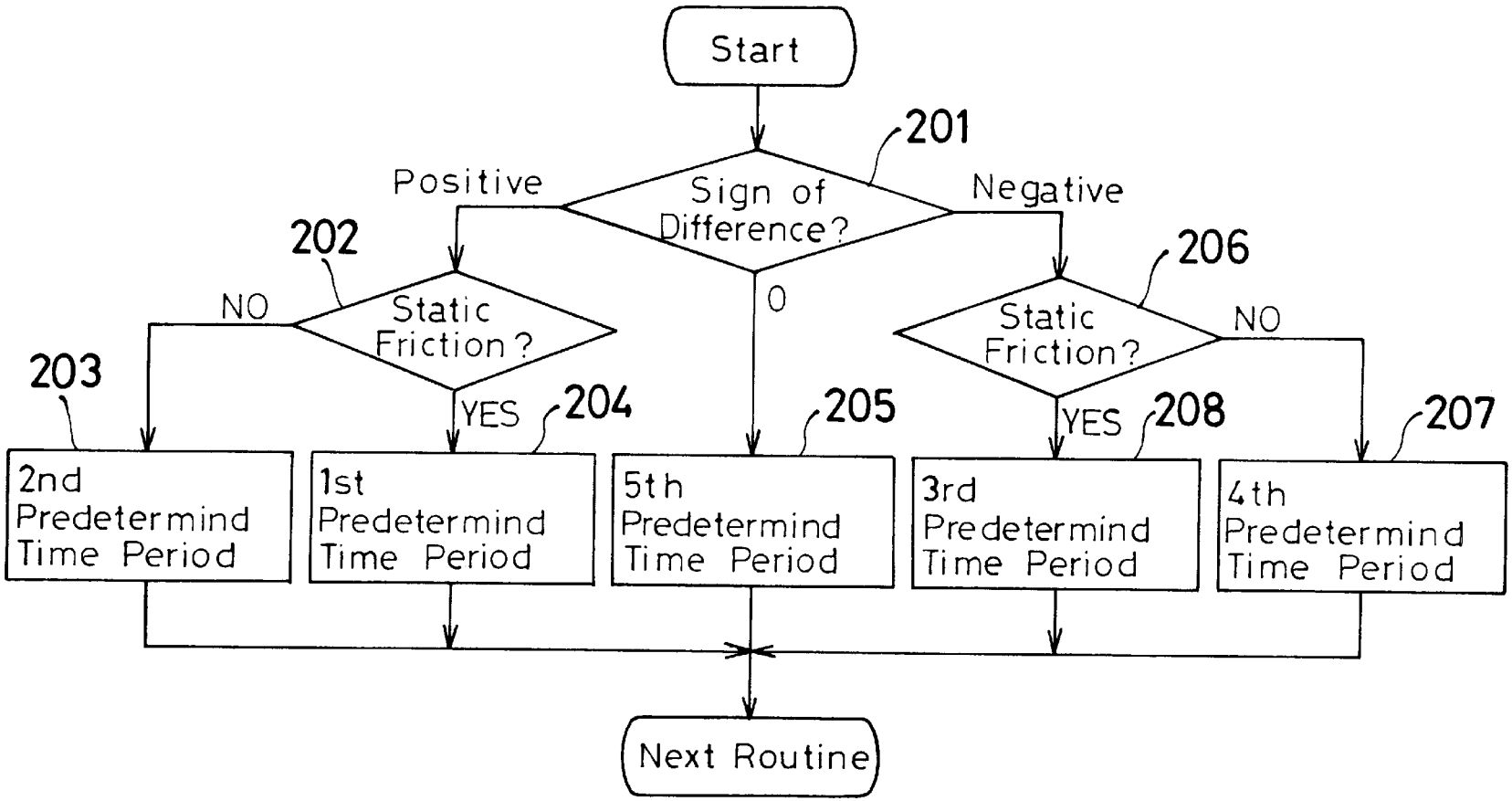
FIG. 4 is a flowchart showing a program for a friction compensation duration.

FIG. 4 shows a subroutine for the friction compensation duration. At step 201, the processing unit 41 judges the sign of the difference between the target position and the present position of the throttle valve 2. If the difference is positive, the processing unit 41 further judges whether or not the throttle valve 2 is affected by the static friction force at step 202. If the throttle valve 2 is affected by the static friction force, the friction compensation duration is set to the first predetermined time period at step 204. If the throttle valve 2 is not affected by the static friction force at step 202, the friction compensation duration is set to the second predetermined time period at step 203. If the difference is negative at step 201, the processing unit 41 further judges whether or not the throttle valve 2 is affected by the static friction force at step 206. If the throttle valve 2 is under the static friction force, the friction compensation duration is set to the third predetermined time period at step 208. If the throttle valve 2 is not under the static friction force at step 206, the friction compensation duration is set to the fourth predetermined time period at step 207. Further, when the processing unit 41 judges the difference is zero at step 201, the friction compensation duration is set to the fifth predetermined time period at step 205. The static friction force is always larger than the dynamic friction force. Therefore, the first predetermined time period for the static friction force is longer than the second predetermined time period for the dynamic friction force. The third predetermined time period for the static friction force is longer than the fourth time period for the dynamic friction force.

Figure 5:
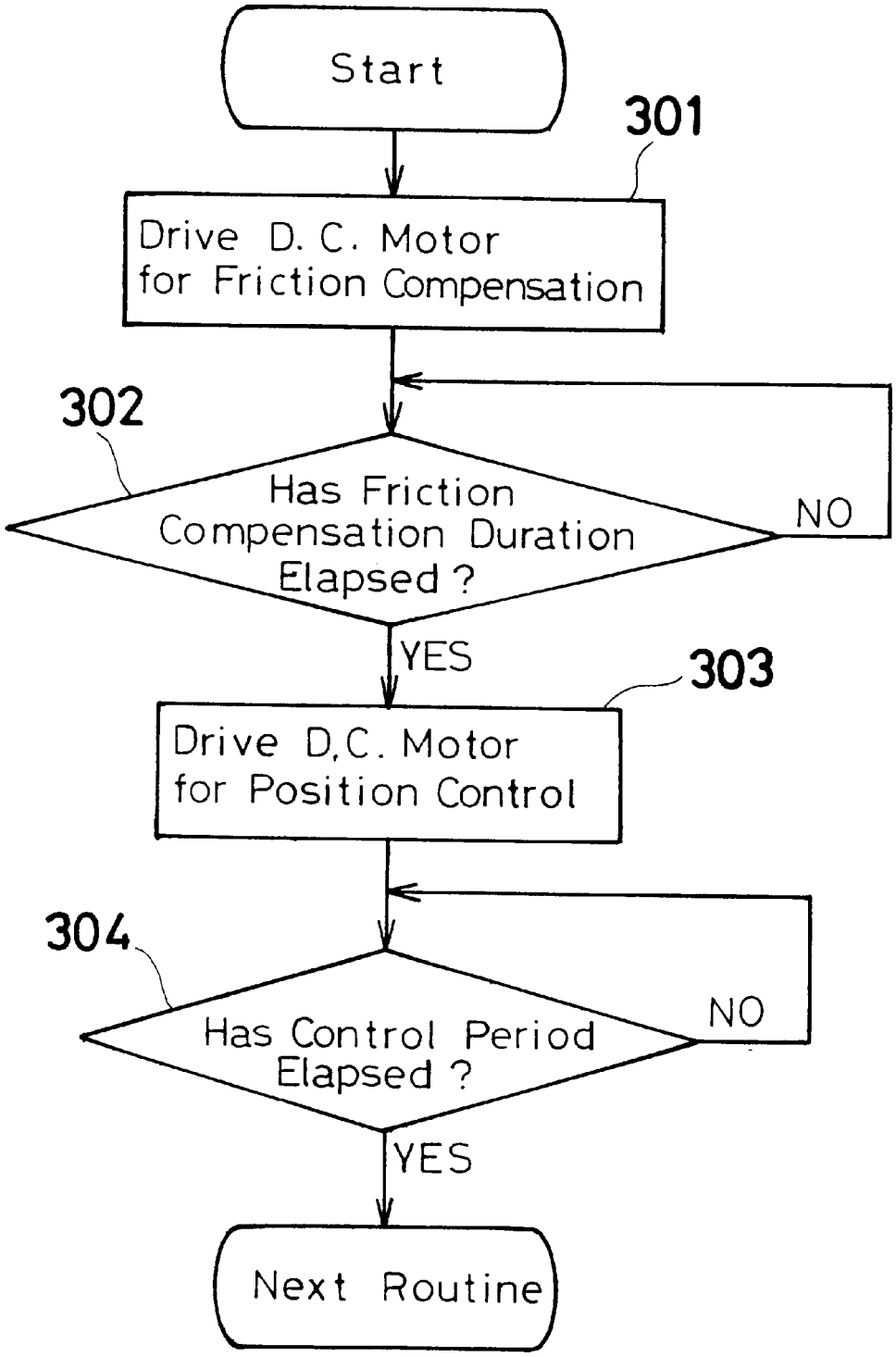
FIG. 5 is a flowchart showing a program to drive a D.C. motor.

FIG. 5 shows a subroutine for driving the D.C. motor 3. At step 301, the friction compensating circuit 44 drives the D.C. motor 3. The output from the friction compensating circuit 44 will be varied depending on the amount of the difference as explained above. At step 302, the friction compensating circuit 44 judges whether or not the friction compensation duration is elapsed. As explained, the friction compensation duration is set in the subroutine shown in FIG. 4. If the friction compensation duration has elapsed, step 303 is executed, but if the friction compensation duration has not yet elapsed, step 302 is repeatedly executed so that the friction compensating circuit 44 keeps the same output. At step 303, the position control circuit 43 drives the D.C. motor 3 so that the throttle valve 2 reaches the target position. At step 304, the position control circuit 43 judges whether or not the control period is elapsed. If the control period has not yet elapsed, step 304 is repeatedly executed so that the position control circuit 43 keeps the same output.

Figure 6:
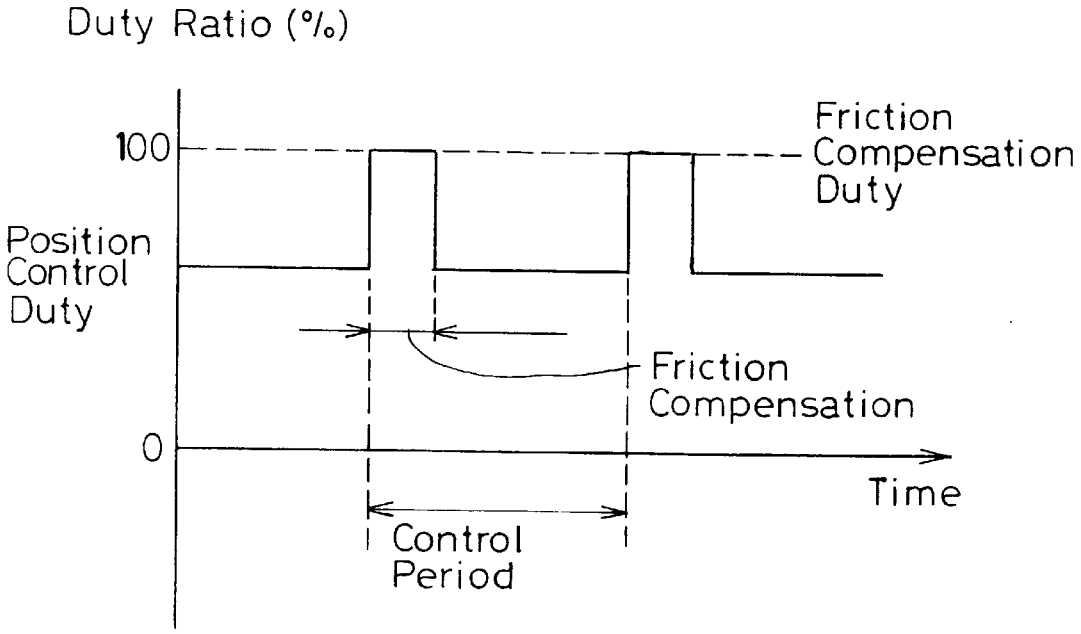
FIG. 6 is a timing chart showing outputs of a position control circuit and a friction compensation circuit while a difference is positive between a target and the present positions of the throttle valve.
Figure 7:
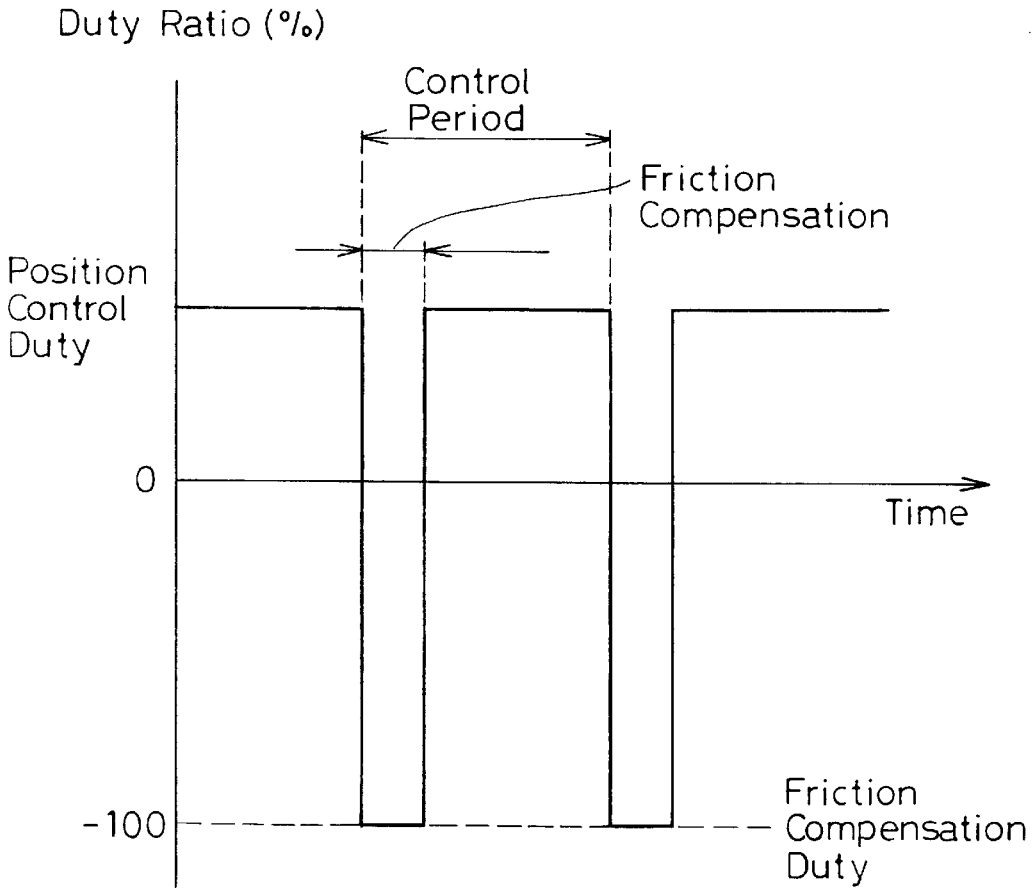
FIG. 7 is a timing chart showing outputs of a position control circuit and a friction compensation circuit while a difference is negative between a target and the present positions of the throttle valve.
Figure 8:
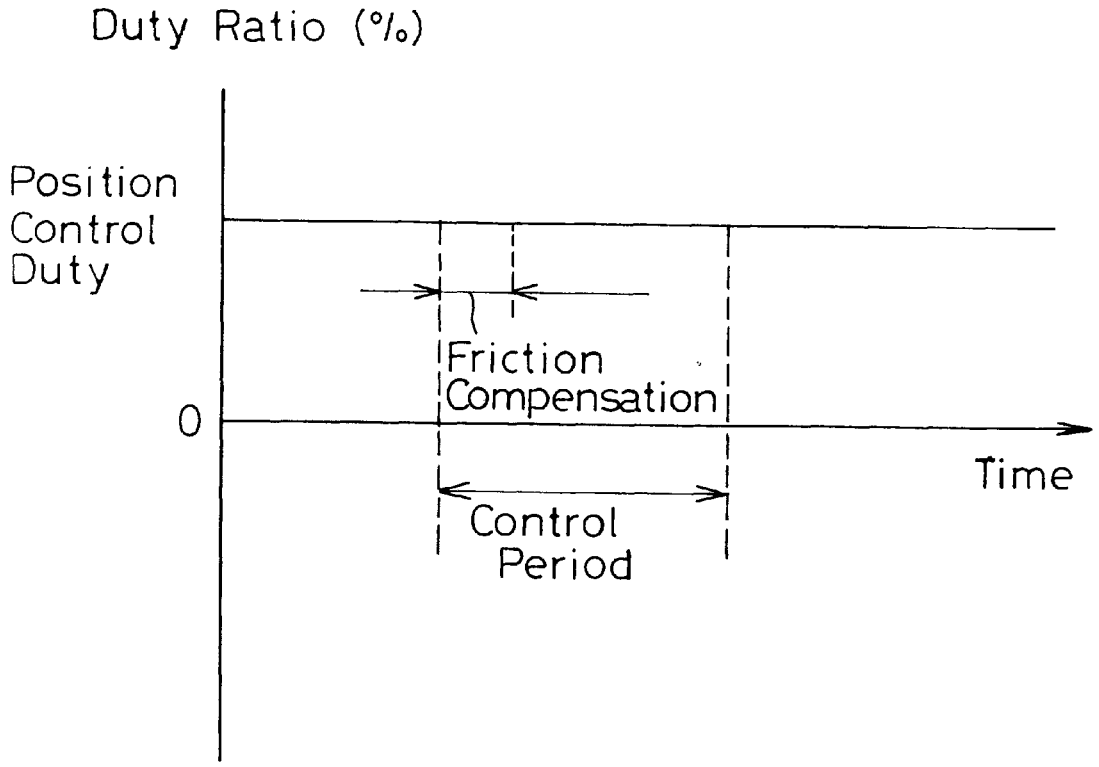
FIG. 8 is a timing chart showing outputs of a position control circuit and a friction compensation circuit when the present position agrees with the target position of the throttle valve.

FIGS. 6, 7 and 8 are timing charts showing outputs of the processing unit 41, the position control circuit 43 and the friction compensating circuit 44. The position control circuit 43 calculates a proper duty ratio according to the servo control using the PID control theory. The friction compensating circuit 44 calculates a proper duty ratio depending on the difference between the target and the present positions of the throttle valve 2. When the present position is closed more than the target position and the sign of the difference is negative, the friction compensating circuit 44 generates a larger duty ratio than the position control circuit 43 to increase supplied power to the D.C. motor 3 as shown in FIG. 6. By doing this, the throttle valve 2 moves toward the target position with the friction compensation. When the present position is more open than the target position and the sign of the difference is positive, the friction compensating circuit 44 generates a smaller duty ratio than the position control circuit 43 as shown in FIG. 7. In FIG. 7, the duty ratio is set to be −100% for the friction compensation so that the direction of the supplied electric current is reversed if compared to the direction of the electric current supplied by the position control circuit 43. In case the present position is equal to the target position so that the difference is zero, no friction compensation is necessary so that the friction compensation circuit 44 generates the same duty ratio as the position control circuit 43 as shown in FIG. 8.

The friction force affecting the throttle valve 2 may vary due to various factors. For example, the friction force to open the throttle valve 2 may be different from that to close the throttle valve 2. Further, the present position of the throttle valve 2 and rotation speed of the throttle valve 2 may also act on the friction force.

During every control period, the processing unit 41 alternatively generates both duty ratios generated by the position control circuit 43 and the friction compensating circuit 44. The D.C. motor 3 will open the throttle valve 2 when the sign of t he difference is positive and will close the throttle valve when the sign of the difference is negative. During every control period of time, any positional error of the throttle valve 2 is effectively compensated by the friction compensating circuit 44 since the D.C. motor 3 generates a compensation torque intermittently in accordance with the friction force affecting the throttle valve 2.

In this embodiment, the duration of the position control may be shortened in exchange for an extension of the friction compensation duration since the processing unit 41 alternatively generates the position control duty and the friction compensation duty during the set control period. In other words, the duration of the position control may be shortened without reducing the control period that requires a more precise processing unit 41. Therefore, the position of the throttle valve 2 may be precisely controlled without requiring additional cost for expensive hardware. Further, the processing unit 41 may be adopted to various throttle valves 2 with relatively easy modifications of the control programs.

It may be possible to modify the friction compensating circuit 44 to change the duty ratio for the friction compensation additionally based on an amount of the difference between the present and target positions of the throttle valve 2.

It may be possible to modify the processing unit 41 to control electric current supplied to the D.C. motor 3 instead of controlling the duty ratio.

In this embodiment, the friction compensating circuit 44 may compensate the positional error generated by the friction force during the same control period as the position control circuit 43. Therefore, the D.C. motor 3 may generate compensated torque in accordance with the friction force that affects the throttle valve 2. By doing this, the throttle valve 2 may be controlled more accurately as if the resolution of the processing unit 41 was increased. Further, the duration of the position control may be shortened by the position control circuit 43 in exchange for an extension of friction compensation duration of the friction compensating circuit 44. Accordingly, more accurate control will be achieved by the same hardware at a certain area such as near the fully closed position of the throttle valve 2.

While the preferred embodiments have been described, variations thereto will occur to those skilled in the art within the scope of the present inventive concepts which are delineated by the following claims.

What is claimed is:

1. A throttle valve controller, comprising:

a motor;

a throttle valve driven by the motor;

detecting means for detecting the actual position of the throttle valve;

position control means for controlling the motor in accordance with a difference between the target position and the actual position of the throttle valve;

friction compensating means for compensating a positional error due to frictional force affecting the throttle valve; and driving means for driving the motor, in a series of repetitive control periods, in accordance with outputs of the position control means and the friction compensating means, wherein the position control means generates a first duty ratio to control said motor to move the throttle valve to the target position, and wherein the friction compensating means generates a second duty ratio to control said motor to compensate the frictional force affecting the throttle valve, and wherein the driving means divides each control period so as to control said motor to move the throttle valve to the target position and to compensate the frictional force affecting the throttle valve within consecutive portions of the same control period.

2. A throttle value controller according to claim 1 wherein the second duty ratio is larger than the first duty ratio when the present position of the throttle valve is at a more closed position than the target position.

3. A throttle valve controller according to claim 2 wherein a sign of the second duty ratio is opposite to a sign of the first duty ratio when the throttle valve moves toward a more closed position from the present position.

4. A throttle valve controller according to claim 1 wherein the second duty ratio is smaller than the first duty ratio when the present position of the throttle valve is at a more open position than the target position.

5. A throttle valve controller according to claim 4 wherein a sign of the second duty ratio is opposite to a sign of the first duty ratio when the throttle valve moves toward a more open position from the present position.

6. A throttle valve controller according to claim 1 wherein the first duty ratio is changed based on the difference between the target position and the actual position of the throttle valve.

7. A throttle valve controller, comprising:

a motor;

a throttle valve driven by the motor;

detecting means for detecting the actual position of the throttle valve;

position control means for controlling the motor in accordance with a difference between the target position and the actual position of the throttle valve;

friction compensating means for compensating a positional error due to frictional force affecting the throttle valve; and driving means for driving the motor in a series of repetitive control periods, in accordance with outputs of the position control means and the friction compensating means, wherein the driving means divides the control period into a first duration for position control and a second duration for friction compensation, wherein said first and second durations are complementarily changed based on the difference between the target position and the actual position of the throttle valve, without varying the duration of said control period.

* * * * *